US009612019B2

(12) United States Patent
Atalay et al.

(10) Patent No.: US 9,612,019 B2
(45) Date of Patent: Apr. 4, 2017

(54) METHOD AND SYSTEM FOR INCREASING THE SAFETY OF GAS-OPERATED COOKING APPLIANCES

(75) Inventors: Engin Atalay, Tekirdag (TR); Zeki Kafali, Tekirdag (TR); Ersin Karaduman, Istanbul (TR)

(73) Assignee: BSH Hausgeräte GmbH, Munich (DE)

( * ) Notice: Subject to any disclaimer, the term of this patent is extended or adjusted under 35 U.S.C. 154(b) by 1304 days.

(21) Appl. No.: 13/515,319

(22) PCT Filed: Dec. 23, 2010

(86) PCT No.: PCT/EP2010/070657

§ 371 (c)(1),
(2), (4) Date: Jun. 12, 2012

(87) PCT Pub. No.: WO2011/080218

PCT Pub. Date: Jul. 7, 2011

(65) Prior Publication Data

US 2012/0247443 A1 Oct. 4, 2012

(30) Foreign Application Priority Data

Dec. 31, 2009 (TR) ..... 2009 10137

(51) Int. Cl.
*F24C 3/12* (2006.01)
*F23N 5/24* (2006.01)
*F23D 14/72* (2006.01)

(52) U.S. Cl.
CPC ..... *F24C 3/12* (2013.01); *F23N 5/245* (2013.01); *F24C 3/126* (2013.01); *F23N 2031/06* (2013.01)

(58) Field of Classification Search
CPC ..... F23N 2035/14; F23N 2027/22
(Continued)

(56) References Cited

U.S. PATENT DOCUMENTS 3,574,308 A * 4/1971 Battersby ..... F23N 5/107 137/637
3,963,410 A * 6/1976 Baysinger ..... F23N 5/123 236/15 A (Continued)

FOREIGN PATENT DOCUMENTS

EP 1528326 A2 5/2005
GB 2186721 A * 8/1987 ..... F24C 3/126

(Continued)

OTHER PUBLICATIONS

International Search Report PCT/EP2010/070657.

*Primary Examiner* — Steven B McAllister
*Assistant Examiner* — Desmond C Peyton
(74) *Attorney, Agent, or Firm* — Michael E. Tschupp; Andre Pallapies

(57) ABSTRACT

A safety system for gas-operated cooking appliances which include at least one burner which is connected to the mains gas network via a distributor, the gas flow of which is controlled by a manually operated gas tap, includes a position switch, a flame detection device, an electrically controlled control valve which is installed in the mains gas network, a manually actuated restoring switch in operable communication with the control valve, and a control circuit. The control circuit is configured to open the control valve after the latter was shut off by the flame detector of the burner only when the control circuit simultaneously receives a signal from the restoring switch and the position switch. The safety system serves as a child safety measure which prevents an inadvertent re-activation of a gas flow system that has been shut off.

22 Claims, 2 Drawing Sheets

(58) Field of Classification Search
USPC ..... 126/42, 39 N; 431/16, 31, 46, 51
See application file for complete search history.

(56) References Cited

U.S. PATENT DOCUMENTS

| | | | | | |
|---|---|---|---|---|---|
| 4,537,345 | A * | 8/1985 | Brown | F23N 1/005 | 236/11 |
| 5,203,688 | A * | 4/1993 | Dietiker | F23N 5/107 | 137/66 |
| 5,282,739 | A * | 2/1994 | Chinsky | F23N 5/102 | 431/51 |
| 5,400,766 | A * | 3/1995 | Dillon | F24C 3/12 | 126/42 |
| 5,875,773 | A | 3/1999 | Jansen | | |
| 6,164,958 | A | 12/2000 | Huang et al. | | |
| 6,733,276 | B1 * | 5/2004 | Kopping | F23N 5/22 | 137/624.11 |

FOREIGN PATENT DOCUMENTS

| | | | |
|---|---|---|---|
| JP | 03236520 | A * | 10/1991 |
| WO | 2009037132 | A1 | 3/2009 |

* cited by examiner

METHOD AND SYSTEM FOR INCREASING THE SAFETY OF GAS-OPERATED COOKING APPLIANCES

TECHNICAL FIELD OF THE INVENTION

The present invention relates to a method and a system for increasing the safety of a cooking appliance, in particular a gas cooker, wherein this cooking appliance comprises at least one gas burner which is connected to the mains gas pipe via a branch pipe and which is provided with a manually operated gas valve for opening and closing the gas flow in said branch pipe and an igniter.

BACKGROUND OF THE INVENTION

Gas-operated cooking appliances usually consist of at least one and generally a greater number of burners, where the ignition of the flame of the burner is provided through use of an external spark igniter. The burner is connected to a mains gas supply line with a branch inbetween the burner and said mains gas supply. With the aid of a switch located inside a burner valve associated with the burner, ignition can be triggered individually on each burner or simultaneously on all of the burners with the aid of a centrally produced ignition signal, wherein this only results in ignition in burners whose valves are open.

If for some reason the flame disappears on one of the burners, e.g. due to a sudden air flow over the cooking appliance or a liquid poured directly on the burner, unburned gas continues to flow through the branch pipe, leading to a potentially hazardous situation on the hotplate. A known measure taken to avoid such hazardous situations is to provide each burner with an electrically controlled valve that is in operable communication with a thermocouple located in each burner and that blocks the inflow of gas to a branch pipe when the respective thermocouple notices a sudden temperature drop at the burner. A typical cooking appliance is shown by way of example in FIG. 1 where this prior art measure is shown schematically. The terms EV1 to EV4 in FIG. 1 stand for electrically controlled valves used to block gas flow into the branch pipes for burners B1 to B4 respectively. T1 to T4 refer to the thermocouples located in the vicinity of the burners B1 to B4 whereas KL indicates the mains gas supply line.

It is known in the prior art that attention should be paid to child safety when reestablishing a flame on a burner whose flame previously extinguished. The example shown in FIG. 1 can be re-operated by mechanically actuating electrically operated valves (EV1-EV4) and ignition can be provided. Due to the fact that burners (B1-B4) cook independently from each other, all other burners that are in operation and that keep their flame burning remain burning, in cases where the flame extinguishes in one of the burners. This clearly creates a new risk in terms of system safety. A second drawback of this solution emerges from the fact that gas-operated cooking appliances generally have more than one burner (mostly four) and it is a very expensive solution to equip each and every burner with an electrically controlled valve for blocking gas flow.

EP 0 727 616 A1 discloses an improved safety device for eliminating the afore-cited safety risks. The system in EP 0 727 616 A1 closes the gas flow into the mains gas supply line instead of into branch lines, as a result of which the cooking appliance is clearly cheaper. According to the teaching of EP 0 727 616 A1, provision is made for a childproof lock in order to avoid unwanted re-lighting of a flame on an extinguished burner. The electromagnetic valve continues to block gas flow from the mains even if an individual burner valve is opened. In order to reactivate the system it is necessary to simultaneously open or close two gas taps or a separate pushbutton shall be pressed for a certain duration. In spite of the fact that additional safety measures have been described in EP 0 727 616 A1, it is known that these measures are not efficient in preventing children from inappropriately activating the blocked safety system of the cooking appliance. A child playing with the taps may open or close any two taps simultaneously or press a pushbutton long enough to activate the system. The safety system proposed in EP 0 727 616 A1 is not perfectly safe due to the play behavior of children and may randomly or unfortunately fail to operate correctly if children play with the valves of this cooking appliance.

Objects of the Invention

An object of the present invention is to provide a safety system for gas-operated cooking appliances where the drawbacks cited above have been eliminated.

A further object of the present invention is to provide a safety system for gas-operated cooking appliances where re-activation of the cooking appliances requires simultaneous use of both hands of a user. A further safety measure proposed in the present invention is that a switch connected to an electrically controlled valve is activated manually, said switching interrupting the gas flow in the mains gas supply and simultaneously closing and opening the tap whose flame has extinguished.

SUMMARY OF THE INVENTION

A gas-operated cooking appliance having a newly designed safety system and a safety system for a gas-operated cooking appliance are disclosed in which at least one burner is connected to the mains gas supply via a branch, the gas flow of which is controlled by a manually operated gas valve. The safety system comprises a position switch for monitoring the position of each gas valve and for transmitting the same as an electric signal, and further a flame detection device adapted to monitor existence of flame on a respective burner and transmit the same as an electric signal. An electrically controlled valve installed on the mains gas supply at a location in between the entry point of gas in the appliance and any one of said gas taps is included. The safety system according to the present invention has a manually actuated resetting switch in operable communication with the control valve. The safety system includes a control circuit which is in communication with each of said position switches, flame detection devices and the control valve. The control circuit is adapted to open a closed control valve only upon simultaneous receipt of a signal from the resetting switch and a signal from the position switch of a burner whose flame detection device has closed the control valve. The object of the safety system according to the present invention is a measure for the safety of children, which eliminates accidental re-activation of a blocked gas flow system and requires deliberate action for opening the gas flow in the appliance.

DESCRIPTION OF EXEMPLARY EMBODIMENTS OF THE PRESENT INVENTION

Figure 1:
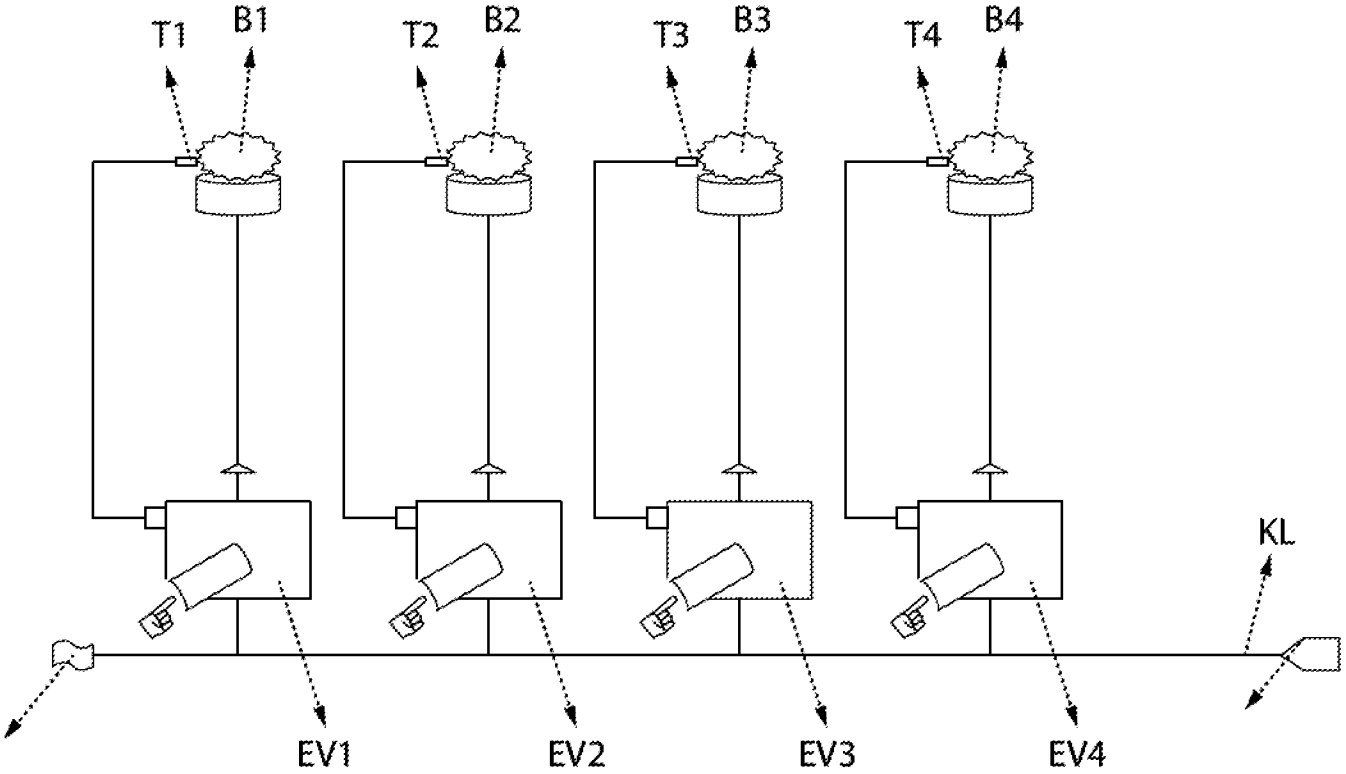
FIG. 1 (PRIOR ART)
FIG. 1 shows a burner system of a gas-operated cooking appliance according to the prior art where electrically controlled valves block the gas flow into the burner branches rather than the main gas supply.
Figure 2:
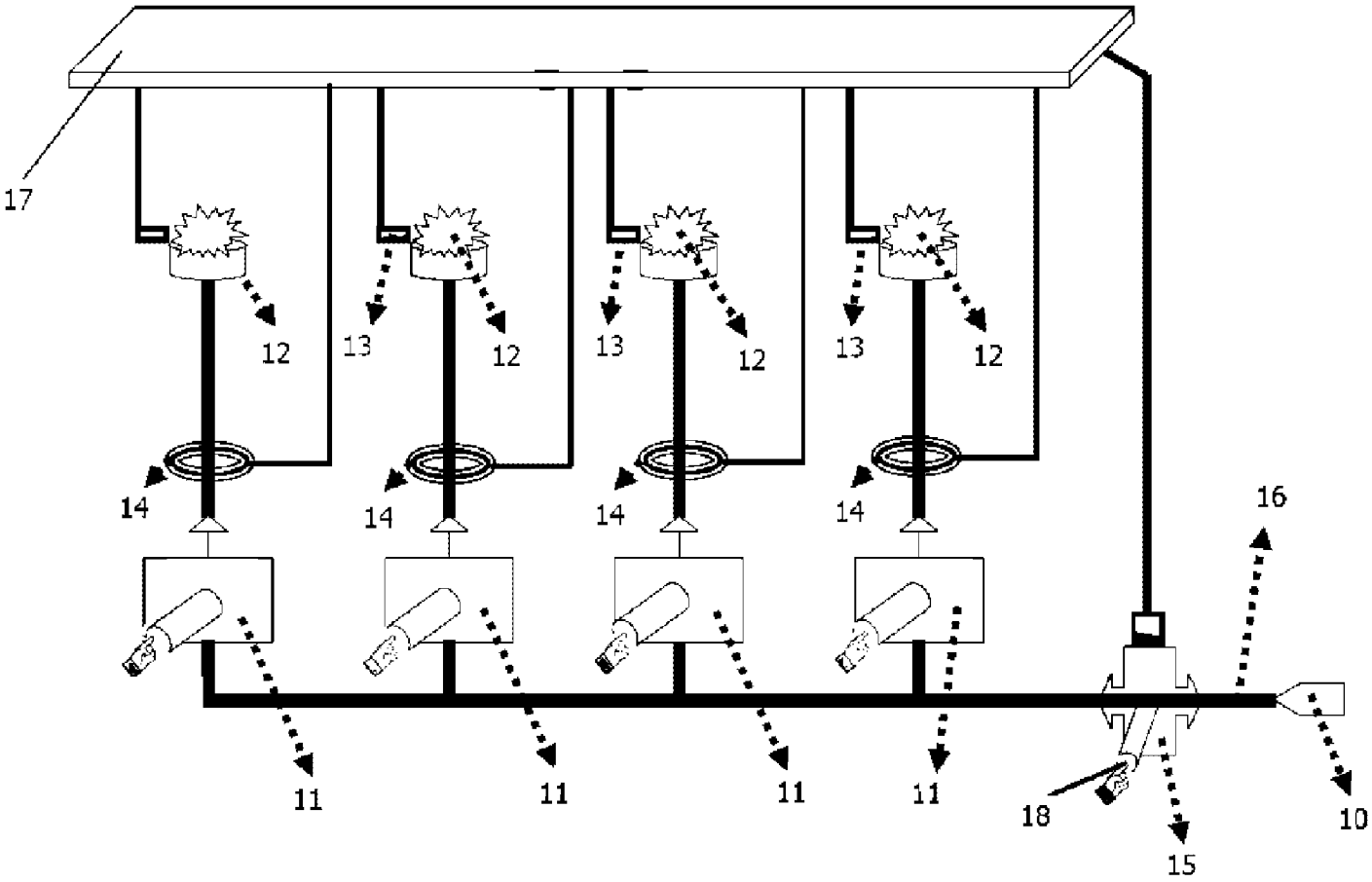
FIG. 2 shows the burner system of a gas-operated cooking appliance as proposed by the present invention.

Gas flow into a burner system according to the present invention is controlled by the control valve (15) located in the mains gas supply (16) at a point before gas is delivered to a branch line for a burner. If all burners (12) are inactive, gas is entrapped between the control valve (15) and the gas entry point (10).

In the event of a flame somehow extinguishing in an active burner, the flame detection device (13) associated with this burner immediately reports the disappearance of the flame to the control circuit (17). The control circuit (17) sends a signal to the control valve (15) and closes the valve in order to block further gas flow in the mains supply (16). This immediately results in the flame on all burners extinguishing and the system status reverting to a "blocked" mode. The control valve (15) has an electromagnetically controlled vent that blocks gas flow upon receipt of the blocking signal from the control circuit (17). In addition to the electrically controlled vent, the control valve (15) further has a mechanically actuated resetting switch (18) that blocks gas flow when not activated manually by the user. If the resetting switch (18) is not activated manually, the control valve (15) would block gas flow to the mains even if the electrically actuated part is open.

The electrically actuated part of the control valve (15) may generally be in the form of a solenoid operated by mains AC voltage or alternatively by a lower voltage DC supply located in the safety system proposed by the invention. Since the gas flow is blocked at the gas mains in an emergency situation, there is no need to use electrically controlled valves at each individual gas tap (11) as opposed to the known systems shown by way of example in FIG. 1. Gas valves (11) according to the present invention are simple, manually-operated valves that are not equipped with electrically actuated blockage devices in order to reduce costs for the burner safety system.

The control circuit (17) continuously monitors the status of the burners (12) and the control valve (15). The status of the burners may be evaluated by comparing signals received from a flame detection device (13). Flame detection devices may typically be in the form of temperature sensors that report temperature on or around a burner (12). In this case, a sudden temperature decrease reported from a flame detection device would mean the flame on the burner (12) associated with that flame detection device has extinguished. Typical sensors produce a potential difference in the level of millivolts when subject to a temperature difference. Therefore it is a good idea to amplify received signals before comparison. An OPAMP circuit can be utilized to accomplish the amplification in an efficient and inexpensive way. This would also allow the control circuit (17) to block the system in a shorter time frame since amplified signals can be compared more easily and faster when detecting the disappearance of a flame. It is clear that it is also possible to use different techniques in order to determine whether or not a flame is present, wherein these different techniques for sensing the flame include, but are not limited to, optical devices or chemical sensors that sense burned or unburned gas.

The control circuit (17) may typically comprise analog circuitry and logic comparators located on a printed circuit board PCB. Nevertheless, it is also possible to use a processor in an alternative embodiment and to execute the same task. Each individual gas valve (11) is monitored by a position switch (14) which informs the control circuit (17) whether a specific valve (11) is in the "on" or "off" position. This information is necessary as the control circuit is not permitted to interpret all "flame not present" signals as a gas leak, since all burners might not have been active at all times. If a flame detection device (13) reports the absence of a flame, this is usually because the corresponding burner (12) was in fact not activated by the user.

The control circuit (17) and also the attached peripherals can be supplied with energy using a transformer fed by the mains electric supply. In case of energy interruptions, the safety system can be supplied with energy by batteries, preferably rechargeable batteries which are permanently connected to the energy supply from the mains and are thereby recharged at all times when there is energy on the mains.

The control valve (15) is preferably adapted to permit the gas flow only when supplied with power and to block the gas flow when it is not supplied with power.

The invention claimed is:

1. A gas-operated cooking appliance, comprising:

at least one burner connected to a mains gas supply by a branch;

a manually operated gas tap for controlling a gas flow of said branch; and a safety system which comprises a position switch for monitoring a position of the manually operated gas tap and for transmitting a first electric signal which indicates the position, a flame detection device for monitoring the presence of a flame on the at least one burner, and for transmitting a second electric signal which indicates whether a flame is present on the at least one burner, an electrically controlled control valve which is arranged in the mains gas supply between an entry point of gas into the appliance and the manually operated gas tap, a manually operated resetting switch in operable communication with said control valve for manually opening said control valve, and a control circuit which is in communication with the position switch, the flame detection device, the manually operated resetting switch, and the control valve, said control circuit being adapted to close the control valve when the second electric signal received by the control circuit indicates that no flame is present on the at least one burner and the first electric signal received by the control circuit indicates an open position of the manually operated gas tap, and to open the closed control valve only in response to simultaneously receiving a signal from the resetting switch and the first electrical signal from the position switch, showing a closing and an opening of the manually operated gas tap, wherein the manual operation of the resetting switch is independent from the manual operation of the gas tap.

2. The gas-operated cooking appliance of claim 1, wherein the control valve is constructed to permit gas flow only when being supplied with power and to block gas flow when not being supplied with power.

3. The gas-operated cooking appliance of claim 1, wherein the flame detection device is a thermocouple which produces voltage when heated.

4. The gas-operated cooking appliance of claim 1, wherein the control circuit comprises an amplifier for amplifying the second electric signal received by the control circuit from the flame detection device.

5. The gas-operated cooking appliance of claim 4, wherein the amplifier is an OPAMP.

6. The gas-operated cooking appliance of claim 1, further comprising multiple of said position switches in one to one correspondence with multiple of said at least one burner, wherein the control circuit is adapted to close the control valve when the first electric signal of each of the position switches indicates a closed position of the manually operated gas tap.

7. The gas-operated cooking appliance of claim 1, wherein the control valve comprises an actuator, said actuator being constructed as a solenoid.

8. A safety system for a gas-operated cooking appliance, comprising:

a position switch for monitoring a position of a manually operated gas tap of the appliance and for transmitting a first electric signal which indicates the position, wherein the appliance comprises at least one burner which is connected to a mains gas supply by a branch, and wherein the manually operated gas tap controls a gas flow of the branch;

a flame detection device for monitoring the presence of a flame on the at least one burner and for transmitting a second electric signal which indicates whether a flame is present on the at least one burner;

an electrically controlled control valve arranged in the mains gas supply between an entry point of gas into the appliance and the manually operated gas tap;

a manually operated resetting switch in operable communication with said control valve for manually opening said control valve; and a control circuit which is in communication with the position switch, the flame detection device, the manually operated resetting switch, and the control valve, said control circuit being adapted to close the control valve when the second electric signal received by the control circuit indicates that no flame is present on the at least one burner and the first electric signal received by the control circuit indicates an open position of the manually operated gas tap, and to open the closed control valve only in response to simultaneously receiving a signal from the resetting switch and the first electric signal from the position switch, showing a closing and an opening of the manually operated gas tap, wherein the manual operation of the resetting switch is independent from the manual operation of the gas tap.

9. The safety system of claim 8, wherein the control valve is adapted to permit gas flow only when being supplied with power and to block the gas flow when not being supplied with power.

10. The safety system of claim 8, wherein the flame detection device is constructed as a thermocouple which produces voltage when being heated.

11. The safety system of claim 8 wherein the control circuit comprises an amplifier for amplifying the second electric signal received by the control circuit from the flame detection device.

12. The safety system of claim 11, wherein the amplifier is an OPAMP.

13. The safety system of claim 8, further comprising multiple of said position switches in one to one correspondence with multiple of said at least one burner, wherein the control circuit is adapted to close the control valve when the first electric signal of each of the position switches indicates a closed position of the manually operated gas tap.

14. The safety system of claim 8, wherein the control valve comprises an actuator, said actuator being constructed as a solenoid.

15. A gas-operated cooking appliance having a mains gas supply, at least one burner, a manually operated gas tap and a safety system, said safety system comprising:

a position switch for monitoring a position of the manually operated gas tap and for transmitting a first electric signal which indicates the position, a flame detection device for monitoring the presence of a flame on the at least one burner, and for transmitting a second electric signal which indicates whether a flame is present on the at least one burner, an electrically controlled control valve which is arranged in the mains gas supply between an entry point of gas into the appliance and the manually operated gas tap, a manually operated resetting switch in operable communication with said control valve for manually opening said control valve, and a control circuit which is in communication with the position switch, the flame detection device, the manually operated resetting switch, and the control valve, said control circuit being adapted to close the control valve when the second electric signal received by the control circuit indicates that no flame is present on the at least one burner and the first electric signal received by the control circuit indicates an open position of the manually operated gas tap, and to open the closed control valve only in response to simultaneously receiving a signal from the resetting switch and the first electric signal from the position switch, showing a closing and an opening of the manually operated gas tap, wherein the manual operation of the resetting switch is independent from the manual operation of the gas tap.

16. The gas-operated cooking appliance of claim 15, wherein the control valve is constructed to permit gas flow only when being supplied with power and to block gas flow when not being supplied with power.

17. The gas-operated cooking appliance of claim 15, wherein the flame detection device is a thermocouple which produces voltage when heated.

18. The gas-operated cooking appliance of claim 15, wherein the control circuit comprises an amplifier for amplifying the second electric signal received by the control circuit from the flame detection device.

19. The gas-operated cooking appliance of claim 18, wherein the amplifier is an OPAMP.

20. The gas-operated cooking appliance of claim 15, further comprising multiple of said position switches in one to one correspondence with multiple of said at least one burner, wherein the control circuit is adapted to close the control valve when the first electric signal of each of the position switches indicates a closed position of the manually operated gas tap.

21. The gas-operated cooking appliance of claim 15, wherein the control valve comprises an actuator, said actuator being constructed as a solenoid.

22. A method for maintaining safety in a gas-operated cooking appliance, comprising the steps of:

monitoring a position of a manually operated gas tap of the appliance with a position switch, and transmitting a first electric signal which indicates said position, wherein the appliance comprises at least one burner which is connected to a mains gas supply by a branch, and wherein the manually operated gas tap controls a gas flow of the branch;

monitoring the presence of a flame on at least one burner of the appliance with a flame detection device and transmitting a second electric signal which indicates whether a flame is present on the at least one burner;

blocking a gas flow in the mains gas supply between an entry point of gas in the appliance and the manually operated gas valve with an electrically controlled valve when the second electric signal indicates that the flame has extinguished and the first electric signal indicates an open position of the manually operated gas tap; and opening the gas flow when a resetting switch on the control valve is manually actuated and, simultaneously, the first electrical signal indicating a closing and opening of the manually operated gas tap is received, wherein the manual actuation of the resetting switch is independent from the manual operation of the gas tap.

* * * * *